United States Patent [19]

Bay

[11] Patent Number: 4,475,254

[45] Date of Patent: Oct. 9, 1984

[54] VISOR ATTACHMENT FOR HELMET SHIELD

[76] Inventor: William P. Bay, Rte. 1, Box 53, Ormond Beach, Fla. 32074

[21] Appl. No.: 415,698

[22] Filed: Sep. 7, 1982

[51] Int. Cl.[3] ..... A42B 3/02

[52] U.S. Cl. ..... 2/424; 2/12

[58] Field of Search ..... 2/424, 12, 422; 24/237, 24/238, 400

[56] References Cited

U.S. PATENT DOCUMENTS

| | | | |
|---|---|---|---|
| 1,473,619 | 11/1923 | Gerhardt | 2/12 |
| 1,959,318 | 5/1934 | Sundback | 24/400 |
| 3,793,681 | 2/1974 | Casstevens, Jr. et al. | 24/238 |

FOREIGN PATENT DOCUMENTS

| | | | |
|---|---|---|---|
| 1286758 | 8/1972 | United Kingdom | 2/12 |

*Primary Examiner*—Werner H. Schroeder
*Assistant Examiner*—J. L. Kravitz
*Attorney, Agent, or Firm*—William M. Hobby III

[57] ABSTRACT

A visor attachment for a helmet shield includes a flexible polymer visor shaped to be attached to one edge portion of a helmet shield. The visor has a visor bill portion and a support portion. The support portion has an arcuate support portion shaped to follow the contour of a shield when flexed thereabout. Several techniques are provided for attaching the visor support portion to the edge portion of the helmet shield in a manner to support the visor even under great stress, so that a shield is converted to a shield and visor combination.

8 Claims, 5 Drawing Figures

FIG. 1
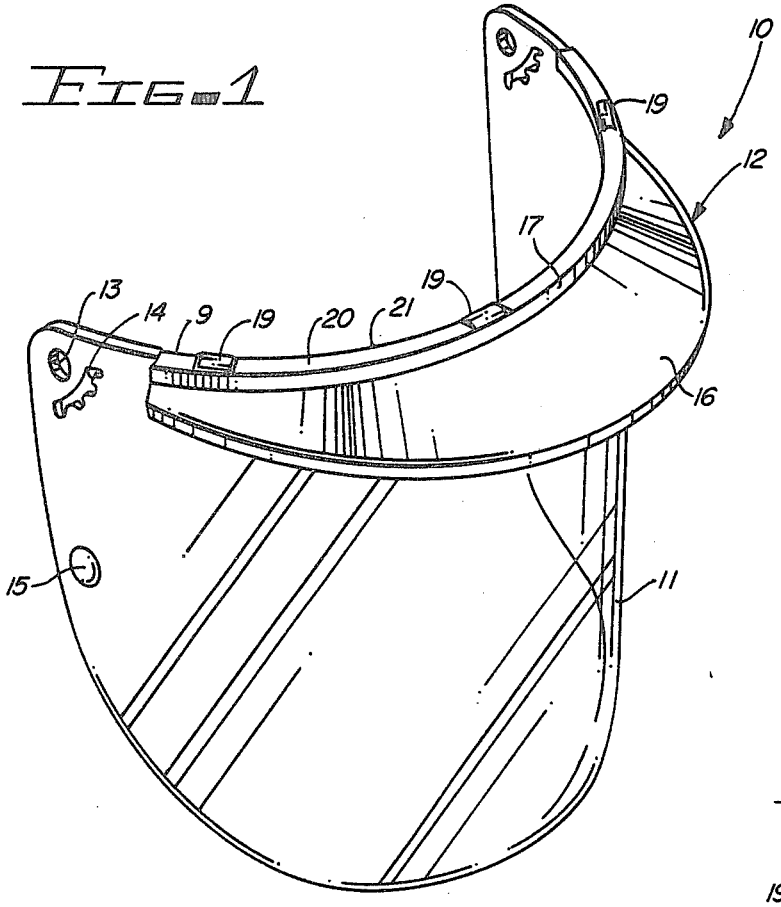
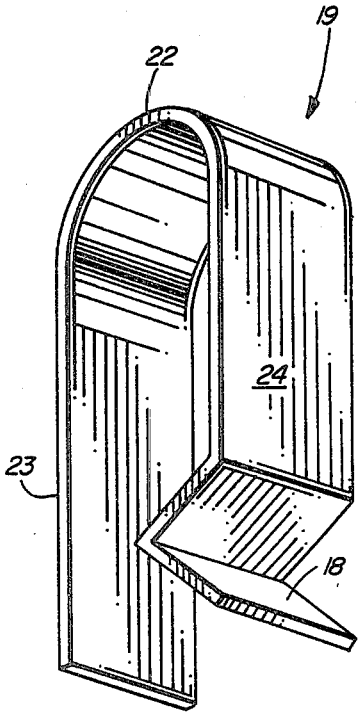
FIG. 2
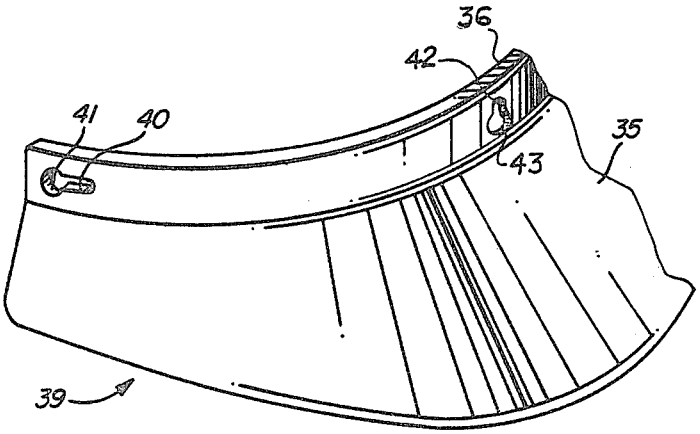
FIG. 4
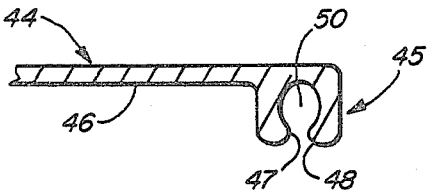
FIG. 5
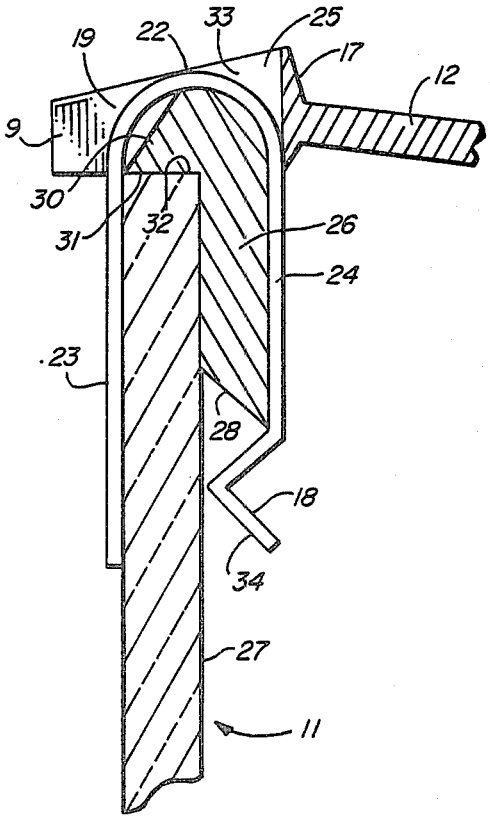
FIG. 3

VISOR ATTACHMENT FOR HELMET SHIELD

BACKGROUND OF THE INVENTION

The present invention relates to a visor attachment for a helmet shield and especially to a universal visor attachment adapted to fit most helmet shields.

In the past, a variety of different types of helmets for the protection of motorcyclists and others have been provided. Typically, this type of helmet has a transparent face shield to protect the face of the user. In recent years, it has been common for some riders to provide their shields having three reversible snaps with a small visor to shade the user's eyes and sometimes the visors are removably attached to the helmet shield. In the case of helmets having snap portions located above the user's eyes for attaching the transparent shield, I have previously suggested the use of additional snap portions on the shield to accept a rigid polymer visor. However, a great many helmets, such as some of the wraparound motorcycle helmets, do not have conveniently placed snap supports for visors. For most helmets today, there is no way to add a visor to a helmet that has not yet made provision therefore. The addition of a visor is difficult because of the stresses that the visor is placed under, such as wind gusts.

The present invention is directed towards a universal type visor which can be attached to the shield of a helmet without damaging the helmet at the option of the helmet owner and which is attached with sufficient strength and with sufficient flex to prevent the visor from snapping loose under strong wind or weather elements.

SUMMARY OF THE INVENTION

The present invention relates to a visor attachment for a helmet shield and includes a flexible polymer visor shaped to be attached to one edge portion of a shield. The visor has a visor bill portion and a support portion for supporting the visor adjacent a helmet shield. The visor support portion has an arcuate support portion shaped to follow the contour of the shield when flexed thereabout and to flex with the attachment of the shield to a helmet. Means are provided for attaching the visor support portion to a shield for converting a shield to a visor/shield combination, and includes special tongues for grasping the edge of the shield when clips for locking the visor to the shield are snapped over each tongue on the visor support portion and over one side of the shield to bind the tongues to the shield.

BRIEF DESCRIPTION OF THE DRAWINGS

Other objects, features and advantages of the present invention will be apparent from the written description and the drawings, in which:

FIG. 1 is a perspective view of a visor attached to a shield in accordance with the present invention;

FIG. 2 is a perspective view of a clip;

FIG. 3 is a sectional view taken through a visor attached to the shield in accordance with FIG. 1;

FIG. 4 is a perspective view of another embodiment of a visor in accordance with the present invention; and FIG. 5 is a sectional view of yet another embodiment of a visor.

DESCRIPTION OF THE PREFERRED EMBODIMENTS

Referring to FIGS. 1 through 3 of the drawings, a visor and shield 10 has the shield 11 having a visor 12 attached thereto. The shield 11 has an aperture 13 on each corner for attaching to a helmet along with a slot 14 used to raise and lower the shield on the helmet and a snap portion 15 for locking the shield in place. The transparent shield 11 is a conventional shield used on existing motorcycle helmets. The visor 12 has a bill portion 16 and a band portion 17 formed with the bill portion 16. The visor 12 is formed of a polymer material that makes it sufficiently flexible to conform to different shapes of shields 11. The universal type visor 12 is attached to the shield 11 with a plurality of clips 19, each clip being formed in a generally U-shape, as shown in FIGS. 2 and 3, having an angled or V-shaped portion 18 to allow the clip to be slid over the edge of the shield 20 and through an opening 21 in the visor. Clip 19 has a curved top portion 22 and a straight backside 23, while the V-shaped portion 18 is formed with a 90° angle.

As seen in FIG. 3, the clip 19 is holding the visor 12 to the shield 11 with the clip leg 23 against the back of the shield 11. The curved portion 22 of the clip 19 located in an opening 25 in the top of the visor 12. The opening 25 in the top of the visor 12 has a visor member passing therethrough having a tongue 26 which protrudes down against the front surface 27 of the shield 11 and has an angled end point 28. Angle point 28 allows visors with clips already installed to be pushed down upon the square edged shield top. Holding the tongue 26 is a member 30 having truncated pyramid shape in cross-section forming a ledge 31 resting on the top edge 32 of the shield 11. Support portion 30 is connected to the sides 33 of the opening 25. In operation, the visor 12 can be placed on the top of the shield and the plurality of clips 19 forced through the openings 25 to apply pressure to the tongue 26 to press the tongue 26 against the front 27 of the shield 11 while the back 23 holds the back of the shield 11 and the ledge 21 rests on the top edge 32 of the shield 11. This provides a strong support for the visor 12 without having to resort to barbs in the clip which would gouge or damage the shield and thereby reduce the strength of the shield, as well as leaving unsightly marks if the visor is ever removed from the shield. The V-shaped portion 18 fits over the ends of the tongue 26 and provides an angled surface 34 to engage the angled surface 35 of the top support member 30 to guide the clip 19 over the tongue 26. The angled portion 18 then fits over the end of the tongue 26 to lock the clip in place. The band portion 17 of the visor 12 hides the spring clip 19 top portion from visibility from the front of the visor 12 and shield 11, while a top curved portion 9 provides additional support by fitting it over the edge 32 of the shield 11.

FIG. 4 shows yet a second modification of a visor for use with the shield 11, in which a visor 39 has a bill portion 35 and a support portion 36 and an elongated horizontal slot 40 having an enlarged portion 41 located on each end portion of the support portion 36. A small slot 42 has an enlarged portion 43 and is located in the approximate center of the support band 36. This visor is attached to a shield 11 by male snap portions by sliding one snap portion in an opening 41 or 43 and sliding it into the slot 40 or 42. This locks the visor into firm position on the helmet and because of the flexibility of the visor, is easily accomplished by attaching the two end slots 40 which aligns the center opening 43.

FIG. 5 shows a last embodiment in which a visor 44 has a pre-formed fastening groove 45 formed as part of the visor 44 along one edge of the bill portion 46. The fastener groove 44 has a grooved portion 50 having a pair of gripping edges 47 having a curved portion 48. The curved portion 48 allows the fastening groove 45 to be slipped onto the edge of the top of a shield 11, thereby expanding the gripping edges 47 and gripping the visor to the shield.

It should be clear at this point that a visor attachment for a helmet shield has been provided which can be attached to a wide variety of shields without having to buy a custom visor made for a particular helmet. It should also be clear that the invention is not limited to the forms shown, which are to be considered illustrative rather than restrictive.

I claim:

1. A visor attachment for a helmet shield comprising in combination:

a flexible polymer visor shaped to be attached to one edge portion of a shield, said visor having a bill portion and a support portion;

said visor support portion having an arcuate band support portion shaped to follow the contour of a shield when flexed thereabout and said visor support portion having openings therein;

means for attaching said support portion to a shield, including a plurality of spring clips passing through said visor support portion openings for locking one edge portion of said shield to said visor support portion, when said visor and shield are flexed to follow an arcuate contour, thereby converting said shield to a visor/shield combination; and each visor support portion opening having a support member therein with a tongue protruding therefrom adjacent to a shield, whereby each said spring clip snaps over said support member and tongue on one side and adjacent to the shield on the other side.

2. A visor in accordance with claim 1, in which said means for attaching said support portion to a shield includes an elongated grooved clip formed in said visor support portion for attaching to one edge of a helmet shield.

3. A visor in accordance with claim 1, in which said spring clips are generally U-shaped clips having a notched area therein for holding each said clip in place.

4. A visor in accordance with claim 3, in which said spring clips have one side thereof having a V-shaped notch therein.

5. A visor in accordance with claim 4, in which said V-shaped notch forms an angled tip forming an enlarged space between tips of said spring clip for sliding said spring clips onto said visor and shield.

6. A visor in accordance with claim 5, in which said support member has angled surfaces for directing said spring clips thereover.

7. A visor in accordance with claim 6, in which said visor support portion extends above the spring clips anchoring said visor to said shield.

8. A visor in accordance with claim 7, in which said visor support portion support member has a flat area resting upon the edge of an attached shield.

* * * * *